US010062344B2

(12) United States Patent
Zhang et al.

(10) Patent No.: US 10,062,344 B2
(45) Date of Patent: Aug. 28, 2018

(54) VOLTAGE STABILIZING DEVICE

(71) Applicant: Shenzhen China Star Optoelectronics Technology Co., Ltd., Shenzhen, Guangdong (CN)

(72) Inventors: Xianming Zhang, Guangdong (CN); Dan Cao, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 224 days.

(21) Appl. No.: 15/118,813

(22) PCT Filed: Jun. 18, 2016

(86) PCT No.: PCT/CN2016/086330

§ 371 (c)(1),
(2) Date: Aug. 12, 2016

(87) PCT Pub. No.: WO2017/197698

PCT Pub. Date: Nov. 23, 2017

(65) Prior Publication Data

US 2018/0174536 A1 Jun. 21, 2018

(30) Foreign Application Priority Data

May 20, 2016 (CN) ..... 2016 1 0345442

(51) Int. Cl.
*G09G 3/36* (2006.01)

(52) U.S. Cl.
CPC ... *G09G 3/3648* (2013.01); *G09G 2310/0291* (2013.01)

(58) Field of Classification Search
CPC ..... G09G 2330/021; G09G 2330/02; G09G 2330/025

(Continued)

(56) References Cited

U.S. PATENT DOCUMENTS

2002/0175662 A1* 11/2002 Sakurai ..... G09G 3/3696 323/312
2003/0043090 A1* 3/2003 Yazawa ..... G09G 3/3216 345/76

(Continued)

FOREIGN PATENT DOCUMENTS

CN 1497516 A 5/2004
CN 103680422 A 3/2014

(Continued)

*Primary Examiner* — Koosha Sharifi-Tafreshi
(74) *Attorney, Agent, or Firm* — Andrew C. Cheng

(57) ABSTRACT

The invention provides a voltage stabilizing device. In the voltage stabilizing device, a signal detecting and amplifying circuit detects an operating voltage of the functional circuit, amplifies the detected operating voltage and outputs the amplified voltage signal to a logic processing circuit; the logic processing circuit adjusts a first control signal according to the amplified voltage signal and outputs the adjusted first control signal to a feedback voltage signal generating circuit; the feedback voltage signal generating circuit adjusts a feedback voltage signal according to the adjusted first control signal and outputs the adjusted feedback voltage signal to the logic processing circuit. Moreover, the logic processing circuit further adjusts a second control signal according to the adjusted feedback voltage signal and outputs the adjusted second control signal to the functional circuit, and thereby controls an output voltage of the functional circuit to be kept stable.

11 Claims, 1 Drawing Sheet

(58) Field of Classification Search
USPC ..... 345/102, 211, 212
See application file for complete search history.

(56) References Cited

U.S. PATENT DOCUMENTS

| | | | | |
|---|---|---|---|---|
| 2005/0110719 | A1* | 5/2005 | Satoh | G09G 3/006 345/76 |
| 2005/0179627 | A1* | 8/2005 | Hayafuji | G09G 3/3233 345/76 |
| 2008/0054984 | A1 | 3/2008 | Lee | |
| 2011/0049985 | A1* | 3/2011 | Fukute | H02M 3/156 307/31 |

FOREIGN PATENT DOCUMENTS

| | | | |
|---|---|---|---|
| CN | 103929060 | A | 7/2014 |
| CN | 204066687 | U | 12/2014 |
| CN | 104575356 | A | 4/2015 |
| CN | 204945542 | U | 1/2016 |
| JP | 2007-4420 | A | 1/2007 |
| KR | 2001-0058177 | A | 7/2001 |

* cited by examiner

VOLTAGE STABILIZING DEVICE

BACKGROUND OF THE INVENTION

1. Technical Field

The invention relates to a voltage stabilizing device in light and heavy load changes, and the voltage stabilizing device can be applied into fields of backlight and driving of liquid crystal display device.

2. Description of Related Art

Nowadays, resolutions of display panels are becoming higher, and correspondingly various currents as required are becoming larger.

However, since pumping load changes of various output voltages are large and meanwhile there are light and heavy load image changes during driving the panel, resulting in that during this period of time, the output voltages would have significant changes in light and heavy load changes caused by decreases of various currents, the output voltages are unstable and ripples are relatively large. Accordingly, the voltage control in light and heavy load changes becomes more important.

SUMMARY OF THE INVENTION

In order to overcome the drawbacks in the prior art, an exemplary embodiments of the invention provides a device capable of controlling and changing feedback voltage amplitude, so that can change different feedback voltages in light and heavy load changes, maintain stability of the output voltage and reduce ripple.

According to an exemplary embodiment of the invention, a voltage stabilizing device adapted for a functional circuit is provided. The voltage stabilizing device includes: a signal detecting and amplifying circuit, a feedback voltage signal generating circuit and a logic processing circuit. The signal detecting and amplifying circuit is configured (i.e., structured and arranged) for detecting an operating voltage of the functional circuit, amplifying the detected operating voltage and outputting the amplified voltage signal to the logic processing circuit. The logic processing circuit is configured for adjusting a first control signal according to the amplified voltage signal and outputting the adjusted first control signal to the feedback voltage signal generating circuit. The feedback voltage signal generating circuit is configured for adjusting a feedback voltage signal according to the adjusted first control signal and outputting the adjusted feedback voltage signal to the logic processing circuit. The logic processing circuit further is configured for adjusting a second control signal according to the adjusted feedback voltage signal and outputting the adjusted second control signal to the functional circuit, and thereby controlling an output voltage of the functional circuit to be kept substantially stable.

Optionally, if an amplitude of the amplified voltage signal is larger than a first threshold, the logic processing circuit makes an amplitude of the feedback voltage signal be decreased and thereby makes the output voltage of the functional circuit controlled by the second control signal be decreased.

Optionally, if an amplitude of the amplified voltage signal is smaller than a first threshold, the logic processing circuit makes an amplitude of the feedback voltage signal be increased and thereby makes the output voltage of the functional circuit controlled by the second control signal be increased.

Optionally, the signal detecting and amplifying circuit includes an operational amplifier, a first resistor and a second resistor. A non-inverting input terminal of the operational amplifier is configured for detecting the operating voltage of the functional circuit, an inverting input terminal of the operational amplifier is electrically connected to grounding potential by the first resistor, an output terminal of the operational amplifier is connected to the logic processing circuit, and the second resistor is connected between the inverting input terminal and the output terminal of the operational amplifier.

Optionally, the feedback voltage signal generating circuit includes a first MOS transistor and a second MOS transistor. A gate of the first MOS transistor and a gate of the second MOS transistor are connected to the logic processing circuit to receive the first control signal, a source of the first MOS transistor and a source of the second MOS transistor both are electrically connected to an output terminal of the functional circuit to receive the output voltage of the functional circuit, a drain of the first MOS transistor is connected to the logic processing circuit to output the feedback voltage signal to the logic processing circuit, and a drain of the second MOS transistor is electrically connected to grounding potential. According to an amplitude of the amplified voltage signal, the logic processing circuit controls turned-on and turned-off states of the first MOS transistor and the second MOS transistor by the first control signal applied onto the gate of the first MOS transistor and the gate of the second MOS transistor and thereby adjusts an amplitude of the feedback voltage signal.

Optionally, if the amplitude of the amplified voltage signal is larger than a first threshold, the logic processing circuit makes the first MOS transistor be turned off while the second MOS transistor be turned on according to the first control signal and thereby makes the amplitude of the feedback voltage signal be decreased. Whereas, if the amplitude of the amplified voltage signal is smaller than the first threshold, the logic processing circuit makes the first MOS transistor be turned on while the second MOS transistor be turned off according to the first control signal and thereby makes the amplitude of the feedback voltage signal be increased.

Optionally, the feedback voltage signal generating circuit further includes a third resistor, a fourth resistor, a fifth resistor, a sixth resistor and a seventh resistor. The source of the first MOS transistor is connected to the output terminal of the functional circuit by the sixth resistor, the source of the second MOS transistor is connected to the output terminal of the functional circuit by serially-connected third resistor and fourth resistor, the drain of the second MOS transistor is electrically connected to grounding potential by the seventh resistor, a terminal of the fifth resistor is connected to the source of the second MOS transistor, and another terminal of the fifth resistor is electrically connected to grounding potential.

Optionally, the functional circuit is a boost circuit, and the boost circuit includes: a third MOS transistor and serially-connected inductor, diode and capacitor. A gate of the third MOS transistor is connected to the logic processing circuit to receive the second control signal from the logic processing circuit, a drain of the third MOS transistor is connected to a node between the inductor and the diode, and a source of the third MOS transistor is electrically connected to grounding potential. If an amplitude of the feedback voltage signal is smaller than a second threshold, the logic processing circuit makes an on-duty cycle of the third MOS transistor be increased by adjusting a duty ratio of the second control signal and thereby controls the output voltage of the functional circuit be increased; whereas if the amplitude of the feedback voltage signal is larger than the second threshold, the logic processing circuit makes the on-duty cycle of the third MOS transistor be decreased by adjusting the duty ratio of the second control signal and thereby controls the output voltage of the functional circuit be decreased.

Optionally, the boost circuit further includes an eighth resistor, and the source of the third MOS transistor is electrically connected to grounding potential by the eighth resistor.

According to an exemplary embodiment of the invention, a driving circuit of a liquid crystal display device is provided. The driving circuit includes any one of the voltage stabilizing devices according to the above embodiments.

Other aspects and/or advantages of the invention will be described in part in the following description, and other part will be apparent from the description or learned from the implementation of the invention.

BRIEF DESCRIPTION OF THE DRAWINGS

The above and/or other objectives and advantages of the invention will be more apparent from the following detailed description taken in conjunction with the accompanying drawings, in which.

DETAILED DESCRIPTION OF EMBODIMENTS

Exemplary embodiments of the invention will be described in detail, and examples of the embodiments are illustrated in the accompanying drawings where same numerical references denote same parts. In the following, the embodiments will be described with reference to the accompanying drawings, in order to explain the invention.

Figure 1:
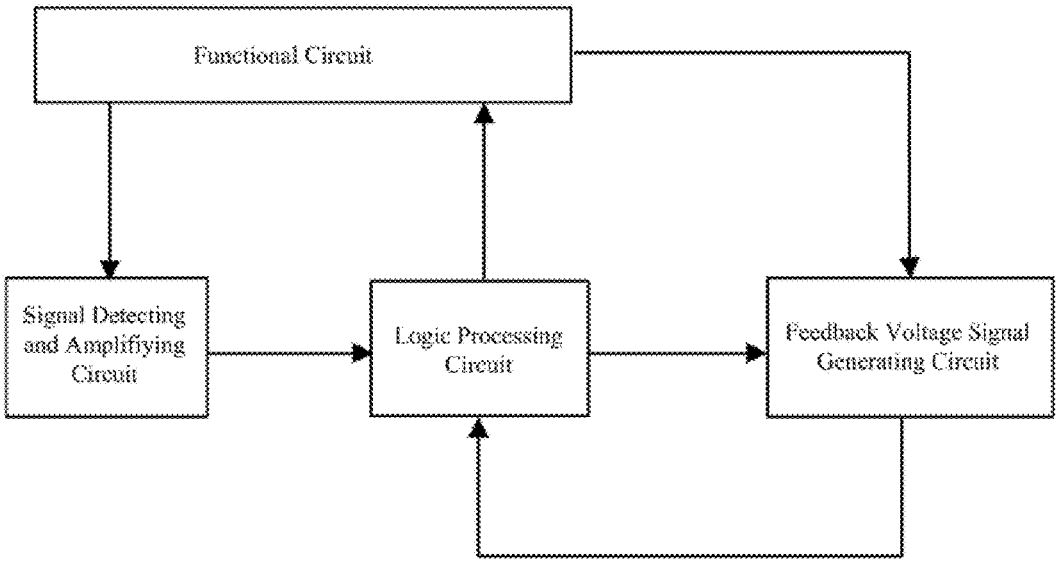
FIG. 1 is a structural block diagram of a voltage stabilizing device adapted for a functional circuit according to an exemplary embodiment of the invention.

FIG. 1 is a structural block diagram of a voltage stabilizing device applied for a functional circuit according to an exemplary embodiment of the invention. As illustrated in FIG. 1, the voltage stabilizing device includes a signal detecting and amplifying circuit, a feedback voltage signal generating circuit and a logic processing circuit. The signal detecting and amplifying circuit is configured (i.e., structured and arranged) for detecting an operating voltage of the functional circuit, amplifying the detected operating voltage and outputting the amplified voltage signal to the logic processing circuit. The logic processing circuit is configured for adjusting a first control signal according to the amplified voltage signal and outputting the adjusted first control signal to the feedback voltage signal generating circuit. The feedback voltage signal generating circuit is configured for adjusting a feedback voltage signal according to the adjusted first control signal and outputting the adjusted feedback voltage signal to the logic processing circuit. Moreover, the feedback voltage signal generating circuit can be connected to the functional circuit to receive an output voltage signal of the functional circuit.

The logic processing circuit further is configured for adjusting a second control signal according to the adjusted feedback voltage signal and outputting the adjusted second control signal to the functional circuit, so as to control the output voltage of the functional circuit to be kept substantially stable.

If an amplitude of the amplified voltage signal is larger than a first threshold, the logic processing circuit makes an amplitude of the feedback voltage signal be decreased, so that the output voltage of the functional circuit controlled by the second control signal is decreased. Or, if the amplitude of the amplified voltage signal is smaller than the first threshold, the logic processing circuit makes the amplitude of the feedback voltage signal be increased, so that the output voltage of the functional circuit controlled by the second control signal is increased.

The voltage stabilizing device can be applied into or integrated into a driving circuit of an electronic equipment such as a liquid crystal display device, so as to achieve functions of voltage regulation and ripple reduction.

Figure 2:
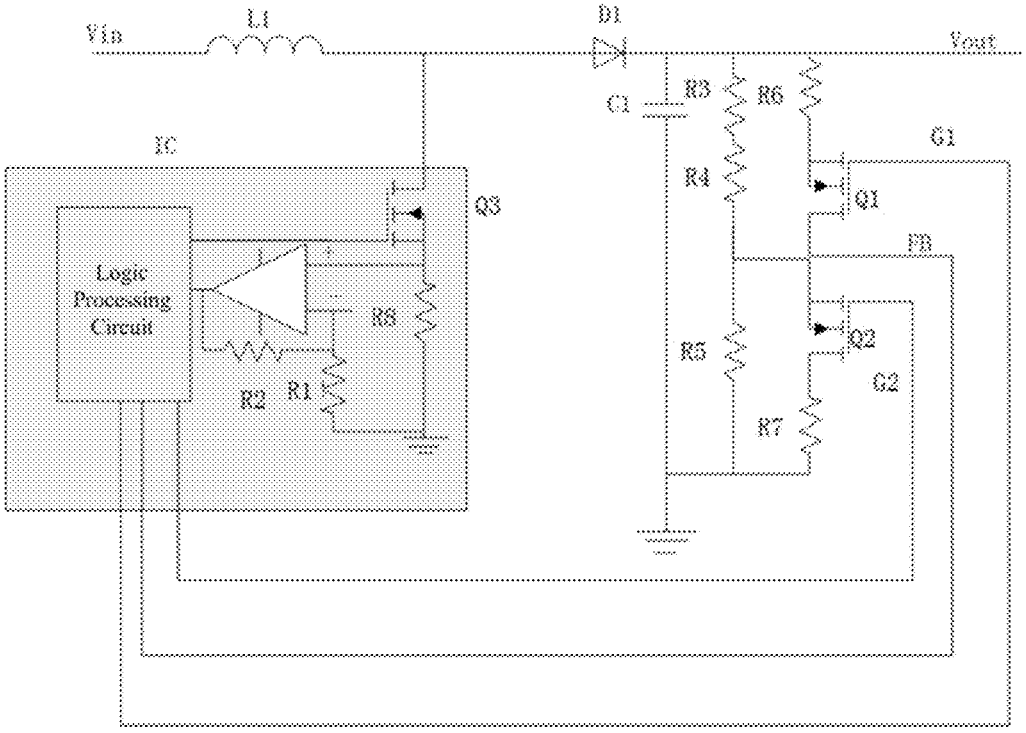
FIG. 2 is a circuit diagram of a voltage stabilizing device adapted for a boost circuit according to an exemplary embodiment of the invention.

FIG. 2 is a circuit diagram of a voltage stabilizing device applied for a boost circuit according to an exemplary embodiment of the invention. As shown in FIG. 2, the boost circuit herein is taken as an example of the functional circuit, and a voltage stabilizing device for the boost circuit is illustrated. Specifically, the voltage stabilizing device includes a signal detecting and amplifying circuit, a feedback voltage signal generating circuit and a logic processing circuit.

The signal detecting and amplifying circuit includes an operational amplifier, a first resistor R1 and a second resistor R2. A non-inverting input terminal of the operational amplifier is configured for detecting an operating voltage of the boost circuit, an inverting input terminal of the operational amplifier is electrically connected to the ground (i.e., grounding potential) via the first resistor R1, and an output terminal of the operational amplifier is connected to the logic processing circuit. The second resistor R2 is connected between the inverting input terminal and the output terminal of the operational amplifier. The signal detecting and amplifying circuit performs an operational amplification onto the detected operating voltage and outputs an amplified voltage signal to the logic processing circuit.

The feedback voltage signal generating circuit includes a first MOS transistor Q1 and a second MOS transistor Q2. A gate of the first MOS transistor Q1 and a gate of the second MOS transistor Q2 are connected to the logic processing circuit to receive a first control signal from the logic processing circuit. The first control signal includes gate driving signals G1 and G2 respectively applied onto the gate of the first MOS transistor Q1 and the gate of the second MOS transistor Q2 by the logic processing circuit, so that the logic processing circuit can use the gate driving signals G1 and G2 to respectively control the first MOS transistor Q1 and the second MOS transistor Q2. In addition, a drain of the first MOS transistor Q1 is connected to the logic processing circuit so as to provide the logic processing circuit with a feedback voltage signal FB.

Optionally, any one of the first MOS transistor Q1 and the second MOS transistor Q2 may be an NMOS transistor.

The feedback voltage signal generating circuit further includes: a third resistor R3, a fourth resistor R4, a fifth resistor R5, a sixth resistor R6 and a seventh resistor R7. A source of the first MOS transistor Q1 is connected to an output terminal of the boost circuit via the sixth resistor R6, a source of the second MOS transistor Q2 is connected to the output terminal of the boost circuit via serially-connected third resistor R3 and fourth resistor R4, a drain of the second MOS transistor Q2 is electrically connected to the ground via the seventh resistor R7, a terminal of the fifth resistor R5 is connected to the source of the second MOS transistor, and another terminal of the fifth resistor R5 is electrically connected to the ground.

The boost circuit includes a third MOS transistor Q3, an eighth resistor R8 and serially-connected inductor L1, diode D1 and capacitor C1. A gate of the third MOS transistor Q3 is connected to the logic processing circuit to receive a second control signal from the logic processing circuit, a drain of the third MOS transistor Q3 is connected to a node between the inductor L1 and the diode D1, and a source of the third MOS transistor Q3 is electrically connected to the ground via the eighth resistor R8. The non-inverting input terminal of the operational amplifier is connected to a node between a terminal of the eighth resistor R8 and the source of the third MOS transistor Q3, and another terminal of the eighth resistor R8 is connected to the ground. The eighth resistor R8 is configured to detect a current of the boost circuit and provides the operational amplifier with a voltage signal, the voltage signal after being amplified by the operational amplifier is inputted to the logic processing circuit for logic processing. The signal can feedback a working condition of the current of the boost circuit in real-time, and different operating currents may feedback different voltages to the logic processing circuit.

Optionally, the third MOS transistor Q3 may be an NMOS transistor.

The logic processing circuit adjusts the gate driving signals G1 and G2 according to the amplified voltage signal, and applies the gate driving signals G1 and G2 onto the gates of the first MOS transistor Q1 and the second MOS transistor Q2 respectively. The first MOS transistor Q1 and the second MOS transistor Q2 adjust the feedback voltage signal FB according to the gate driving signal G1 and G2.

In the example of boost circuit, the logic processing circuit, the operational amplifier, the resistor R8 and the third MOS transistor Q3 are contained in an integrated circuit (IC) module.

The logic processing circuit controls turned-on and turned-off states of the first MOS transistor Q1 and the second MOS transistor Q2 according to the signal at different voltage levels received from the operational amplifier. For example, if an amplitude of the voltage is larger than a specific threshold (i.e., means the operating current is large), the logic processing circuit controls the second MOS transistor Q2 to be turned on while the first MOS transistor Q1 to be turned off by the gate driving signals G1 and G2 respectively applied onto the gate of the first MOS transistor Q1 and the gate of the second MOS transistor Q2, which can make the amplitude of the feedback voltage signal FB be decreased, and correspondingly the output voltage of the boost circuit is decreased. Meanwhile, the feedback voltage signal FB is provided to the logic processing circuit, so as to make the IC module to compensate the decrease/drop of the output voltage caused by large current and reduce ripple. In addition, if the amplitude of the voltage is smaller than the specific threshold (i.e., means the operating current is small), the logic processing circuit controls the first MOS transistor Q1 to be turned on while the second MOS transistor Q2 to be turned off by the gate driving signals G1 and G2, which would make the amplitude of the feedback voltage signal FB be increased, and correspondingly the output voltage of the boost circuit is increased. In addition, the feedback voltage signal FB is provided to the logic processing circuit, so as to make the IC module to compensate the retrieve/increase of the output voltage caused by the small current and reduce ripple. The specific threshold can be set according actual requirement.

Optionally, besides detects the output voltage level of the operational amplifier, the logic processing circuit further detects the feedback voltage signal FB. The logic processing circuit controls an on-duty cycle of the third MOS transistor Q3 by adjusting a duty ratio of the second control signal applied onto the gate of the third MOS transistor Q3 according to the amplitude of the feedback voltage signal FB, and thereby controls the magnitude of the overall output voltage Vout so as to perform compensation in time. For example, if the amplitude of the detected feedback voltage signal FB is smaller than another specific threshold, the logic processing circuit makes the on-duty cycle of the third MOS transistor Q3 be increased by adjusting the duty ratio of the second control signal; whereas if the amplitude of the detected feedback voltage signal FB is larger than the another specific threshold, the logic processing circuit makes the on-duty cycle of the third MOS transistor Q3 be decreased by adjusting the duty ratio of the second control signal, so that the output voltage Vout of the boost circuit is dropped/decreased. The another specific threshold can be set according to actual requirement. As above described, it can further achieve the voltage stabilizing function of the voltage stabilizing device.

Optionally, the logic processing circuit further may include an error amplifier (not shown). The error amplifier is configured for monitoring the feedback voltage signal FB and comparing the feedback voltage signal FB with a preset predetermined signal, so that the logic processing circuit can adjust the duty ratio of the second control signal as per the foregoing described manner and thereby adjust the magnitude of the on-duty cycle of the third MOS transistor Q3.

As described above, when works in a circumstance of light and heavy load changes, the voltage stabilizing device can effectively feedback the magnitude of output load in time and make the output be basically stable in a straight line by controlling feedback, and thereby can reduce ripple while maintaining the stability of the output voltage.

It is noted that, the invention only illustrates some electronic components. The skilled person in the art can set more finely-divided resistors and compensation circuits according to requirements and can set more resistors and MOS transistors, so as to achieve a more stable control.

Although the invention takes the above circuit structures as examples, the voltage stabilizing device can be applied for various functional circuits (e.g., the above described boost circuit) and further can be extended into other topological architectures. For example, the voltage stabilizing device can be applied into a driving circuit of a liquid crystal display deice, so as to achieve functions of voltage regulation and ripple reduction.

In addition, based on the processing carried out by various elements defined by the invention, the skilled person in the art can make the voltage stabilizing device according to the exemplary embodiments of the invention be a variety of hardware components according to requirements and then be applied for various electronic equipments.

The above embodiments of the invention are merely exemplary, and the invention is not limited thereto. Those skilled in the art should be understood that without departing from the principle and spirit of the invention, various modifications can be made to these embodiments. The scope of the invention is defined in the claims and their equivalents.

What is claimed is:

1. A voltage stabilizing device adapted for a functional circuit, comprising:

a signal detecting and amplifying circuit, a feedback voltage signal generating circuit and a logic processing circuit;

wherein: the signal detecting and amplifying circuit is configured for detecting an operating voltage of the functional circuit, amplifying the detected operating voltage and outputting an amplified voltage signal to the logic processing circuit;

the logic processing circuit is configured for adjusting a first control signal according to the amplified voltage signal and outputting the adjusted first control signal to the feedback voltage signal generating circuit;

the feedback voltage signal generating circuit is configured for adjusting a feedback voltage signal according to the adjusted first control signal and outputting the adjusted feedback voltage signal to the logic processing circuit;

the logic processing circuit further is configured for adjusting a second control signal according to the adjusted feedback voltage signal and outputting the adjusted second control signal to the functional circuit, and thereby controlling an output voltage of the functional circuit to be kept substantially stable.

2. The voltage stabilizing device as claimed in claim 1, wherein if an amplitude of the amplified voltage signal is larger than a first threshold, the logic processing circuit makes an amplitude of the feedback voltage signal be decreased and thereby makes the output voltage of the functional circuit controlled by the second control signal be decreased.

3. The voltage stabilizing device as claimed in claim 1, wherein if an amplitude of the amplified voltage signal is smaller than a first threshold, the logic processing circuit makes an amplitude of the feedback voltage signal be increased and thereby makes the output voltage of the functional circuit controlled by the second control signal be increased.

4. The voltage stabilizing device as claimed in claim 1, wherein the signal detecting and amplifying circuit comprises an operational amplifier, a first resistor and a second resistor;

a non-inverting input terminal of the operational amplifier is configured for detecting the operating voltage of the functional circuit, an inverting input terminal of the operational amplifier is electrically connected to grounding potential by the first resistor, an output terminal of the operational amplifier is connected to the logic processing circuit, and the second resistor is connected between the inverting input terminal and the output terminal of the operational amplifier.

5. The voltage stabilizing device as claimed in claim 1, wherein the feedback voltage signal generating circuit comprises a first MOS transistor and a second MOS transistor;

a gate of the first MOS transistor and a gate of the second MOS transistor are connected to the logic processing circuit to receive the first control signal, a source of the first MOS transistor and a source of the second MOS transistor both are electrically connected to an output terminal of the functional circuit to receive the output voltage of the functional circuit, a drain of the first MOS transistor is connected to the logic processing circuit to output the feedback voltage signal to the logic processing circuit, and a drain of the second MOS transistor is electrically connected to grounding potential;

wherein, according to an amplitude of the amplified voltage signal, the logic processing circuit controls turned-on and turned-off states of the first MOS transistor and the second MOS transistor by the first control signal applied onto the gate of the first MOS transistor and the gate of the second MOS transistor and thereby adjusts an amplitude of the feedback voltage signal.

6. The voltage stabilizing device as claimed in claim 5, wherein if the amplitude of the amplified voltage signal is larger than a first threshold, the logic processing circuit makes the first MOS transistor be turned off while the second MOS transistor be turned on according to the first control signal and thereby makes the amplitude of the feedback voltage signal be decreased; whereas if the amplitude of the amplified voltage signal is smaller than the first threshold, the logic processing circuit makes the first MOS transistor be turned on while the second MOS transistor be turned off according to the first control signal and thereby makes the amplitude of the feedback voltage signal be increased.

7. The voltage stabilizing device as claimed in claim 5, wherein the feedback voltage signal generating circuit further comprises a third resistor, a fourth resistor, a fifth resistor, a sixth resistor and a seventh resistor;

the source of the first MOS transistor is connected to the output terminal of the functional circuit by the sixth resistor, the source of the second MOS transistor is connected to the output terminal of the functional circuit by serially-connected third resistor and fourth resistor, the drain of the second MOS transistor is electrically connected to grounding potential by the seventh resistor, a terminal of the fifth resistor is connected to the source of the second MOS transistor, and another terminal of the fifth resistor is electrically connected to grounding potential.

8. The voltage stabilizing device as claimed in claim 6, wherein the feedback voltage signal generating circuit further comprises a third resistor, a fourth resistor, a fifth resistor, a sixth resistor and a seventh resistor;

the source of the first MOS transistor is connected to the output terminal of the functional circuit by the sixth resistor, the source of the second MOS transistor is connected to the output terminal of the functional circuit by serially-connected third resistor and fourth resistor, the drain of the second MOS transistor is electrically connected to grounding potential by the seventh resistor, a terminal of the fifth resistor is connected to the source of the second MOS transistor, and another terminal of the fifth resistor is electrically connected to grounding potential.

9. The voltage stabilizing device as claimed in claim 1, wherein the functional circuit is a boost circuit, and the boost circuit comprises: a third MOS transistor and serially-connected inductor, diode and capacitor;

a gate of the third MOS transistor is connected to the logic processing circuit to receive the second control signal from the logic processing circuit, a drain of the third MOS transistor is connected to a node between the inductor and the diode, and a source of the third MOS transistor is electrically connected to grounding potential;

if an amplitude of the feedback voltage signal is smaller than a second threshold, the logic processing circuit makes an on-duty cycle of the third MOS transistor be increased by adjusting a duty ratio of the second control signal and thereby controls the output voltage of the functional circuit be increased; whereas if the amplitude of the feedback voltage signal is larger than the second threshold, the logic processing circuit makes the on-duty cycle of the third MOS transistor be decreased by adjusting the duty ratio of the second control signal and thereby controls the output voltage of the functional circuit be decreased.

10. The voltage stabilizing device as claimed in claim 9, wherein the boost circuit further comprises an eighth resistor, and the source of the third MOS transistor is electrically connected to grounding potential by the eighth resistor.

11. A driving circuit of a liquid crystal display device, comprising a voltage stabilizing device adapted for a functional circuit;

wherein the voltage stabilizing device comprises a signal detecting and amplifying circuit, a feedback voltage signal generating circuit and a logic processing circuit;

the signal detecting and amplifying circuit is configured for detecting an operating voltage of the functional circuit, amplifying the detected operating voltage and outputting an amplified voltage signal to the logic processing circuit;

the logic processing circuit is configured for adjusting a first control signal according to the amplified voltage signal and outputting the adjusted first control signal to the feedback voltage signal generating circuit;

the feedback voltage signal generating circuit is configured for adjusting a feedback voltage signal according to the adjusted first control signal and outputting the adjusted feedback voltage signal to the logic processing circuit;

the logic processing circuit further is configured for adjusting a second control signal according to the adjusted feedback voltage signal and outputting the adjusted second control signal to the functional circuit, and thereby controlling an output voltage of the functional circuit to be kept substantially stable.

* * * * *